US006352428B1

(12) United States Patent
Uribetxebarria et al.

(10) Patent No.: US 6,352,428 B1
(45) Date of Patent: Mar. 5, 2002

(54) VALVE ARRANGEMENT FOR CONTROLLING A GAS FIREPLACE

(75) Inventors: José J. Antxia Uribetxebarria, Aretxabaleta; Maite Amozarrain Atxa, Mondragon, both of (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 09/603,110

(22) Filed: Jun. 22, 2000

(30) Foreign Application Priority Data

Jul. 30, 1999 (ES) ..... P9901727

(51) Int. Cl.[7] ..... F16K 31/12

(52) U.S. Cl. ..... 431/80; 126/512; 137/66; 251/30.02

(58) Field of Search ..... 431/125, 80; 126/512; 137/65, 66, 613; 251/30.01, 30.02, 83; 236/1 A, 1 H

(56) References Cited

U.S. PATENT DOCUMENTS 3,090,560 A * 5/1963 Holzboog ..... 236/68 D
3,630,648 A * 12/1971 Hulsman ..... 137/66
4,778,378 A * 10/1988 Dolnick et al. ..... 137/65
5,044,390 A * 9/1991 Kelly et al. ..... 137/66
5,484,103 A * 1/1996 Schultz et al. ..... 137/66

FOREIGN PATENT DOCUMENTS

GB 2327749 A * 2/1999 ..... 126/512

* cited by examiner

*Primary Examiner*—Sara Clarke
(74) *Attorney, Agent, or Firm*—The Kline Law Firm

(57) ABSTRACT

Valve arrangement (1,2) for automatically controlling the gas flow in the burner of a gas fireplace appliance, comprising a manual flow regulating tap (1) connected to the gas supply and provided with a rotary control knob (1*a*), a gas switching servovalve operated by a diaphragm (8), connected in series to the manual valve outlet (1*b*), and whose action is governed by an auxiliary electromagnetic bleed valve (5,15), an electronic control circuit (3) supplied by an electrical battery (4) and an electrical thermostat switch inserted in the auxiliary valve supply line.

1 Claim, 1 Drawing Sheet

VALVE ARRANGEMENT FOR CONTROLLING A GAS FIREPLACE

BACKGROUND OF THE INVENTION

The present invention relates to the gas switching valves or servovalves operated by fluid pressure by way of a diaphragm and which act under the control of an auxiliary valve, and to the arrangement and assembly of combustion control devices in a gas heating appliance.

Valves arrangements are known for the automatic control of the gas flow in an artificial gas fireplace, as described in U.S. Pat. No. 5,674,065, wherein an electromagnetic switching valve is supplied by the voltage self-generated by a thermopile heated by a pilot flame, the valve being switched by a bimetal thermostat located away from the burner, in response to the variations in temperature of the heated area. At the gas supply intake this known flow control device has an electromagnetic safety valve energized by a flame thermocouple.

Valves with a manual gas flow regulating control are used for the burners of portable stoves and gas cookers, such as the type described in U.S. Pat. No. 5,375,585 with a rotary taper valve member, and which has a built-in electric switch operated by pressing the stem manually and an electromagnetic safety valve energized with a flame thermocouple, for ignition purposes.

EP-319257-A shows a valve arrangement for a gas heating appliance, comprising a first manual valve with various positions activating a pilot flame igniter and permitting the passage of the gas flow to the block of series valves, activated by remote control to supply a burner.

U.S. Pat. No. 4,073,611 discloses a valve arrangement for gas control in a burner appliance, comprising a first electromagnetic safety valve controlling a pilot flame, and a second main valve for controlling the burner supply, the flow of gas being received from the first valve, means for igniting the pilot flame and for flame detection, and an electrical circuit for energizing the igniter and the second valve.

Gas flow switching servovalves are also known, such as the one described in U.S. Pat. No. 3,880,186, which is operated by way of a diaphragm by the difference in pressure in the chambers on both sides, controlled by an auxiliary electromagnetic bleed valve.

SUMMARY OF THE INVENTION

The object of the present invention is a gas valve arrangement for controlling the gas flow in a gas heating appliance for an area, which works automatically, governed by an electronic circuit and supplied by a low voltage battery.

Due to the lower power consumption required for controlling the gas valve arrangement, a first regulating valve or tap is operated by hand by means of a rotary control and a second switching valve or servovalve fitted in series with the first one is operated by gas pressure by means of a diaphragm, with the assistance of an auxiliary low-power electromagnetic valve, and in response to a room temperature thermostat, which does not consume electric power either. The manual valve has a rotary control, while the valve stem in turn is axially sliding and pushes an electromagnetic safety valve for its initial opening which is built into the gas supply inlet to the manual tap.

The operation of the valve arrangement is automatic, since the initial actuation of the stem of the first valve, besides allowing gas to flow to the pilot flame, provides the igniter supply and energizes the safety valve by way of the control circuit. The electronic control circuit may also be activated from a remote control, acting on the ignition and safety valve energizing. The switching servovalve has to be operated with very little electric power.

DESCRIPTION OF THE PREFERRED EMBODIMENT

Figures 1, 2:
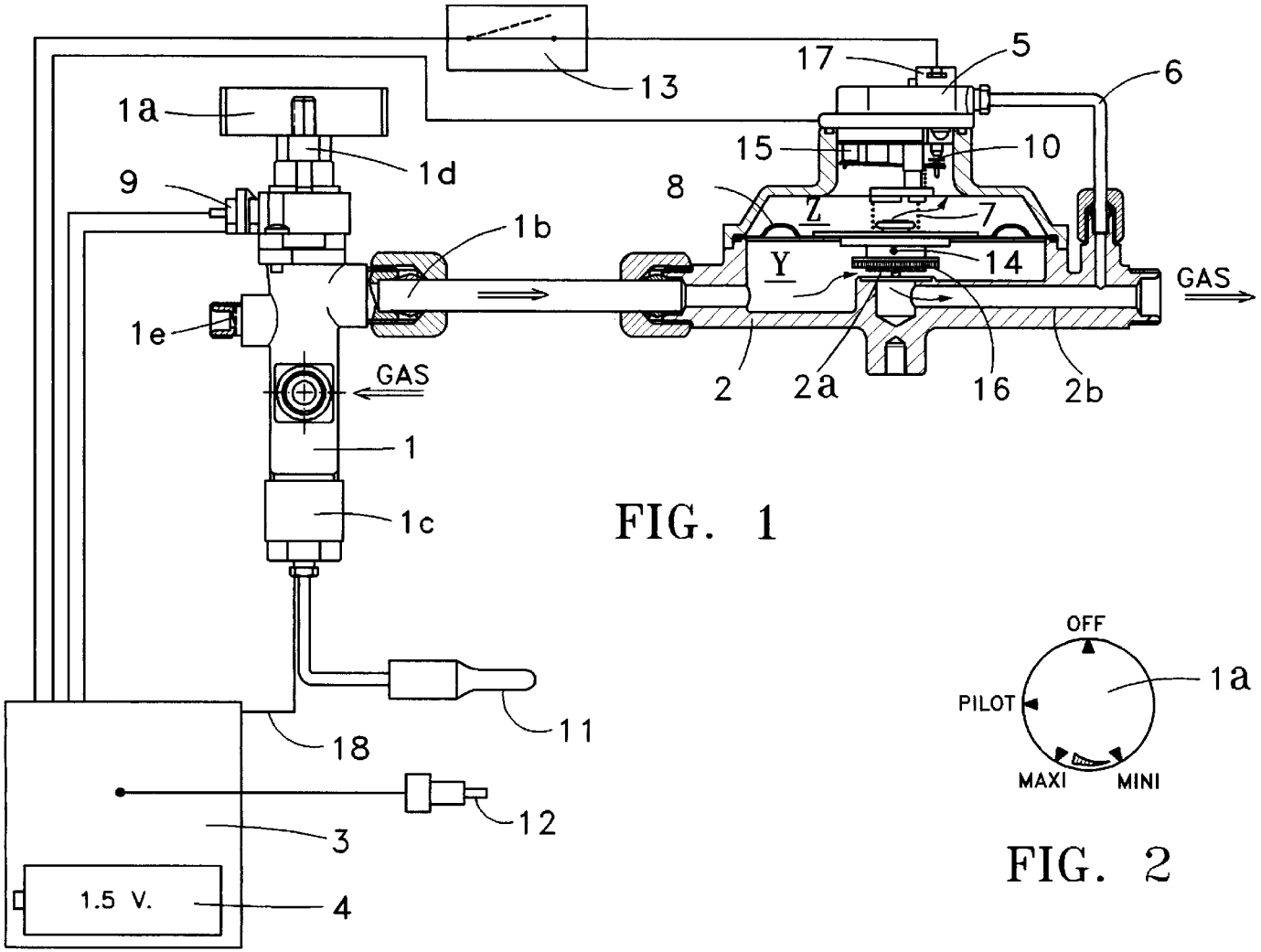
FIG. 1 is a view of the valve arrangement for controlling gas flow according to the invention.
FIG. 2 is a top view of the rotary knob 1*a* shown in FIG. 1.

In reference to FIG. 1, the valve arrangement 1,2,3 for controlling a flow gas according to the invention, comprises a first manual regulating valve 1, which has a built-in electromagnetic flame safety valve 1*c*, and a rotary knob control 1*a* regulating the gas flow to a main burner and to a pilot burner, not shown in the drawings, a servovalve 2 connected to the manual valve 1 through a connection pipe 1*b*, a low consumption electronic circuit 3 connected to a voltage battery 4 for controlling the valve arrangement 1,2,3, and a room temperature thermostat 13.

The servovalve 2 has an open-closed gas flow switching action in response to the action of the thermostat 13. The servovalve 2 is the diaphragm type provided with a main gas flow switching valve 2*a*, an auxiliary bleed valve 5 energized by the battery 4, and an gas outlet pipe 2*b* to the main burner.

The switching valve 2*a* is divided into two gas chambers by a diaphragm 8, a main gas chamber Y and an auxiliary chamber Z, and lifts a valve cutting-off sealing member 16 by action of the pressure difference between both gas chambers Y,Z, thus opening the switching valve and placing the main chamber Y in communication with the gas outlet pipe 2*b*. When the auxiliary valve 5 is disenergized, pressure of chambers Y,Z is equalized by way of a gas passage hole 14, communicating both chambers through the diaphragm 8. Communicating hole 14 is drilled in the valve stem and is of restricted diameter, for allowing only to pass an equalization gas through the diaphragm 8. When the differential pressure between both chambers Y,Z is cancelled out, the valve sealing member 16 seals the main valve 2*a* urged by the spring 7.

Auxiliary valve 5 is a bleed solenoid valve actuated by a electromagnet 15, and has a valve hole 10 to bleed the auxiliary chamber Z. The flow gas switching occurs in response to the action of the thermostat 13, which is located away from the burner. When the thermostat contact 13 closes, the electromagnet 15 is energized and the bleed hole 10 is opened, allowing a gas flow greater than the flow that passes through the diaphragm 8 via the communicating hole 14, to issue via a bleed pipe 6 from the auxiliary chamber Z. Thus the pressure in the auxiliary chamber Z is lower and the diaphragm 8 lifts the sealing member 16 for the flow of gas through the main valve 2*a* to the outlet pipe 2*b*.

The action of the stem 1*d* of the manual valve 1 closes an electric switch 9 coupled to the stem 1*d*, by way of which the control circuit 3 supplies a fireplace burner igniter 12, and at the same time activates the circuit 3 for energizing the safety valve 1*c*, by way of an electromagnet line 18. A simultaneous turn of the stem 1*d* allows the gas to flow to the pilot burner via an outlet pipe 1*e* bypassing the main control valve 1, and a subsequent turn opens up the main flow of gas, in an amount varying from a maximum flow position to a minimum flow position, to the connection pipe 1*b* of the manual valve and servovalve 2. The safety valve 1*c* is energized by a flame thermocouple 11, so that it is maintained in an open position once the pilot burner is ignited.

The auxiliary bleed valve 5,10,15 is mounted on the servovalve 2 above the auxiliary chamber Z, and it has an outer casing 5 housing a quick connector 17 for connecting the thermostat switch 13, and on the side it has a leakproof outlet for the gas bled off, which is ducted by the bleed pipe 6, which is leakproof and is connected to the pipe 2*b* supplying gas to the main burner.

The invention claimed is:

1. A gas flow control valve arrangement adapted to be used with at least one main burner and a pilot burner of a gas fireplace appliance, comprising:

a main valve controlled by a rotary knob, said main valve comprises a main outlet that supplies gas to a main gas flow and a pilot outlet that bypasses said main outlet, a valve controlled by said rotary knob to regulate a gas flow to the at least one main burner and to the pilot burner, and an electromagnetic safety valve, an independent servovalve for directing said gas flow to the main burner, said servovalve is mounted in series with said main valve, and operation of said servovalve is governed by an electromagnetic auxiliary valve, said auxiliary valve being controlled by a thermostat, and a control circuit that controls a pilot flame igniter and electrical activation of said auxiliary valve, and a thermocouple cooperating with said control circuit to operate said safety valve; wherein said servovalve comprises a diaphragm separating a main gas chamber from an auxiliary gas chamber, said servovalve further comprises an outlet pipe in communication with the main burner, and said main gas chamber is in communication with said auxiliary gas chamber by means of a restricted diameter hole such that pressures in said main gas chamber and in said auxiliary gas chamber are equalized, and said auxiliary valve on said servovalve bleeds said auxiliary gas chamber, said auxiliary valve being in communication with said outlet pipe via a sealed bleed pipe that transports gas bled off said auxiliary gas chamber to said outlet pipe, and said main gas chamber is in line with said main gas flow and thereby supplies gas to the main burner.

* * * * *